US007614899B2

(12) United States Patent
Zhu et al.

(10) Patent No.: US 7,614,899 B2
(45) Date of Patent: Nov. 10, 2009

(54) ELECTRICAL CONNECTOR ASSEMBLY

(75) Inventors: Jian-Kuang Zhu, Kunshan (CN); Xiao-Gao Yang, Kunshan (CN); Wei-Hua Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,230

(22) Filed: Jan. 29, 2009

(65) Prior Publication Data

US 2009/0191763 A1 Jul. 30, 2009

(30) Foreign Application Priority Data

Jan. 29, 2008 (CN) ..... 2008 2 0031812 U

(51) Int. Cl.
*H01R 13/62* (2006.01)

(52) U.S. Cl. ..... 439/325; 439/326

(58) Field of Classification Search ..... 439/325, 439/326, 61, 62, 65, 69, 74, 541.5
See application file for complete search history.

(56) References Cited

U.S. PATENT DOCUMENTS

| | | | | | |
|---|---|---|---|---|---|
| 3,736,471 | A * | 5/1973 | Donze et al. | ..... | 361/679.31 |
| 4,776,804 | A * | 10/1988 | Johnson et al. | ..... | 439/62 |
| 5,641,295 | A * | 6/1997 | Koyama | ..... | 439/326 |
| 5,755,585 | A * | 5/1998 | Cheng et al. | ..... | 439/326 |
| 5,975,916 | A * | 11/1999 | Okura | ..... | 439/74 |
| 6,126,472 | A * | 10/2000 | Choy | ..... | 439/328 |
| 7,261,592 | B2 * | 8/2007 | Korsunsky et al. | ..... | 439/541.5 |
| 2007/0099514 | A1 * | 5/2007 | Ito | ..... | 439/660 |

* cited by examiner

*Primary Examiner*—Chandrika Prasad
(74) *Attorney, Agent, or Firm*—Andrew C. Cheng; Wei Te Chung; Ming Chieh Chang

(57) ABSTRACT

An electrical connector includes a main board (5) with a first card edge connector (1) mounted thereon, a sub-board (6) with a second card edge connector (2) mounted thereon, and a pair of complementary board to board connectors (3, 4) mounted on the main board (5) and the sub-board (6) respectively. The first and second card edge connectors (1, 2) are aligned with each other in a vertical direction and the second card edge connector (2) is on top of the first card edge connector (1).

20 Claims, 10 Drawing Sheets

ELECTRICAL CONNECTOR ASSEMBLY

BACKGROUND OF THE INVENTION

1. Field of the Invention

The present invention relates to an electrical connector assembly for receiving a pair of memory modules therein.

2. Description of the Related Art

Duplex profile connector assembly for receiving modules therein is common knowledge in the area of PC industry. U.S. Pat. No. 6,126,472 discloses such a connector assembly, the assembly includes a lower housing and an upper housing substantially offsetting with each other in a front-to-rear direction. Each housing defines two rows of passageways on two sides of a central slot, in which the corresponding module is received. A plurality of terminals are received within the corresponding passageways wherein a tail of each terminal extends downward to be mounted on a PCB.

Due to continuing trend toward complicated and improved electrical performance by the electronic device, said assembly doesn't meet the new requirement, and a new electrical connector assembly is needed.

SUMMARY OF THE INVENTION

Accordingly, an object of the present invention is to provide an electrical connector assembly with standard electrical connectors and reasonable combination.

In order to achieve the object set forth, an electrical connector assembly comprises a main board with a first card edge connector mounted thereon; a sub-board with a second card edge connector mounted thereon; a pair of complementary board to board connectors mounted on the main board and the sub-board respectively. The first and second card edge connectors are aligned with each other in a vertical direction and the second card edge connector is on top of the first card edge connector.

Other objects, advantages and novel features of the invention will become more apparent from the following detailed description of the present embodiment when taken in conjunction with the accompanying drawings.

DETAILED DESCRIPTION OF THE INVENTION

Figure 1:
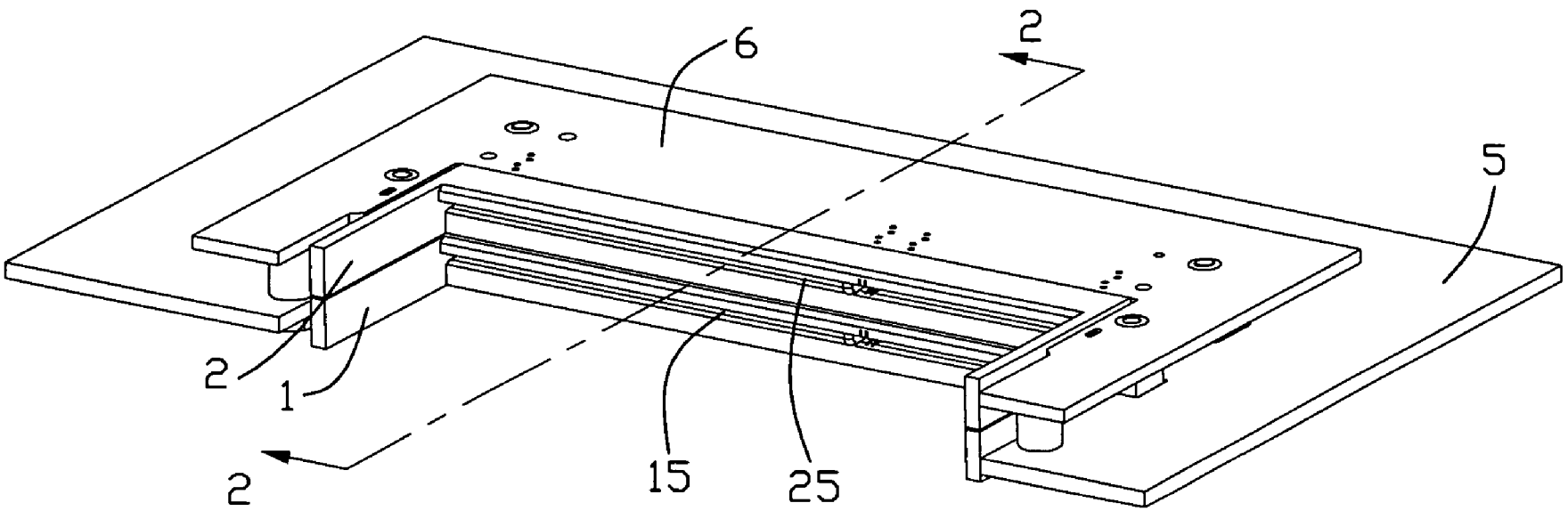
FIG. 1 is a perspective view of an electrical connector assembly in accordance with the present invention, comprising a first card edge connector mounting onto a main board, a second card edge connector mounting onto a sub-board, and a pair of complementary board to board connectors connecting the main board and sub-board.
Figure 2:
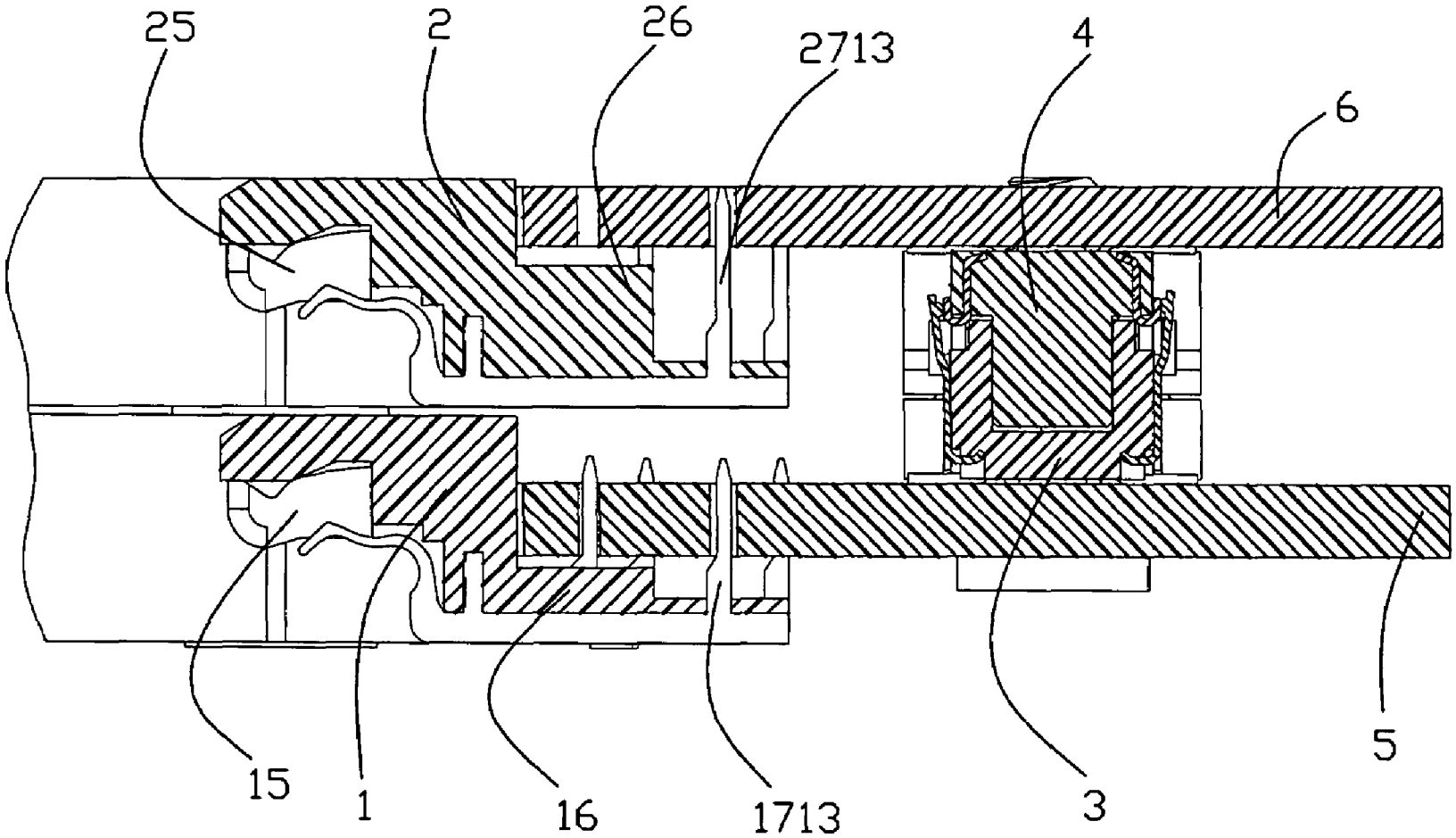
FIG. 2 is a cross-sectional view of the electrical connector assembly along line 2-2 in FIG. 1.

Reference will now be made to the drawing figures to describe a preferred embodiment of the present invention in detail. Referring to FIGS. 1 and 2, an electrical connector assembly according to the preferred embodiment of the present invention is provided and comprises a main board 5 with a first card edge connector 1 mounted thereon, a sub-board 6 with a second card edge connector 2 mounted thereon, and a pair of complementary board-to-board connectors 3, 4 located between the main board 5 and sub-board 6.

Figure 3:
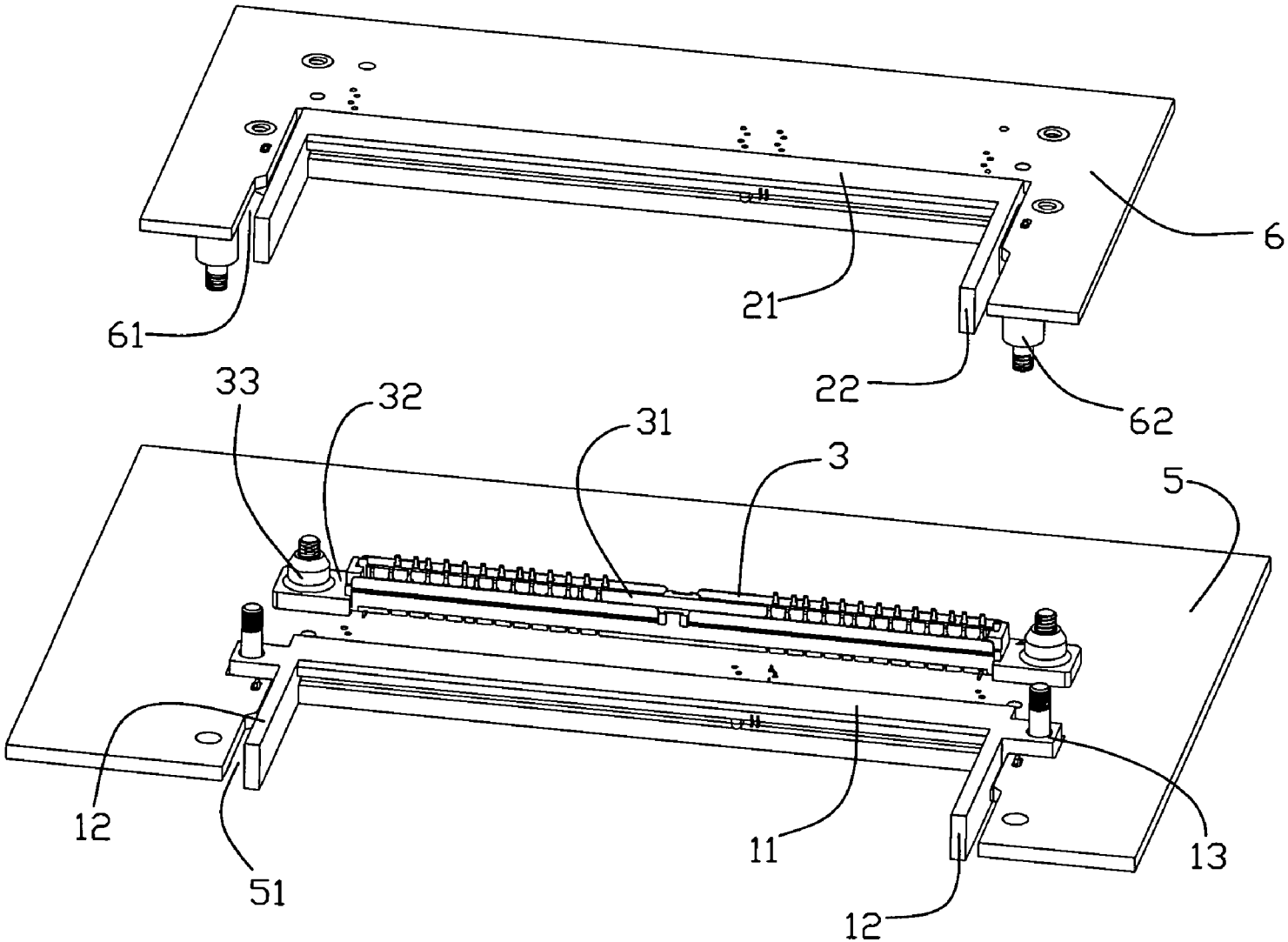
FIG. 3 is an exploded view of the electrical connector assembly shown in FIG. 1.
Figure 4:
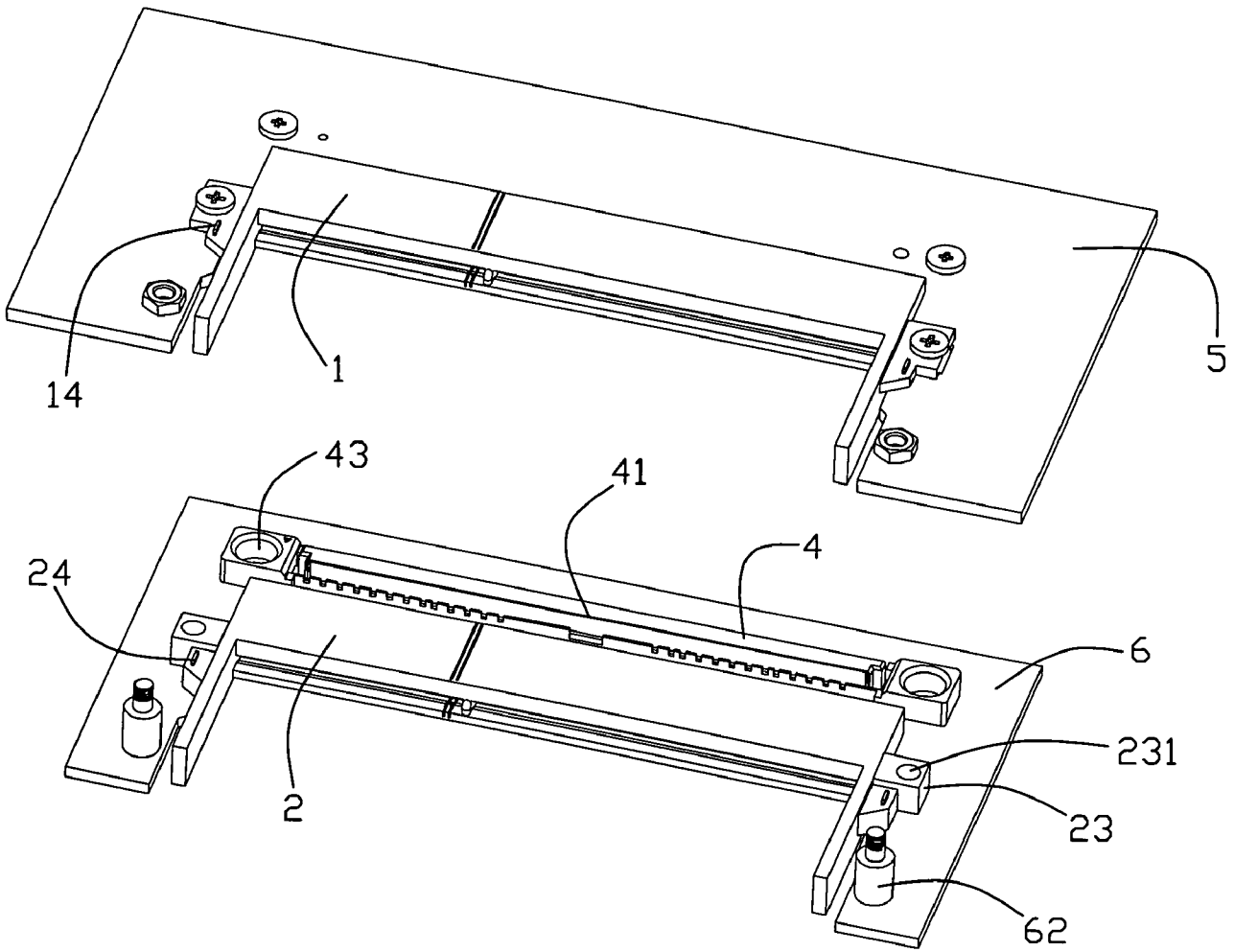
FIG. 4 is another exploded view of the electrical connector assembly shown in FIG. 1.

Referring to FIGS. 3 and 4, the sub-board 6 is located above the main board 5, therefore a direction from the main board 5 to a sub-board 6 is defined as a vertical direction. Each board 5, 6 has a notch 51, 61 recessed rearward thereby defining a space for receiving the corresponding card edge connector, and the recessing direction is defined as a front-to-rear direction.

The structures of the first and second card edge connectors 1, 2 are nearly the same, and each comprise an elongated housing 11/21 and a pair of arms 12/22 extending from opposite ends of the housing. A pair of supporting portions 13/23 respectively extend outwardly from side edges of the arms 12/22 and each supporting portion has a metallic tip 14/24 molded therein. The first card edge connector 1 is located in the notch 51 of the main board 5, and the supporting portions 13 abut against edges of the main board 1 around the notch 51, meanwhile, the tips 14 are inserted into the main board for retaining the first card edge connector 1 thereon. The second card edge connector 2 is mounted on the sub-board 6 in a same way as the first one and located on top of the first one.

The main board 5 and the sub-board 6 are connected with each other by the pair of complementary board to board connectors 3, 4. The first board to board connector 3 is mounted on the main board 5 and located behind the first card edge connector 1. The first board to board connector 3 has an elongated housing 31 in parallel to the first card edge connector 1, and a pair of mounting portions 32 with guiding post 33 thereon at opposite ends of the housing 31. The second board to board connector 4 has a nearly same configuration with the first board to board connector 3, and defines a pair of through holes 43 at opposite ends for receiving the guiding post 33 therein and combining the first and second board to board connectors 3, 4 together.

Each supporting portion 13/23 of the first or second card edge connectors defines a guiding hole 131/231 therein corresponding with the through holes on the boards 5/6. A plurality of screws 15 are provided to run through the guiding holes 131, 231 and through holes to tighten the first and second card edge connectors 1, 2 together with the main board 5 and sub-board 6. The sub-board 6 forms a plurality of guiding post thereon to be inserted into the corresponding through holes defined on the main board 5 for further tightening the main board 5 and sub-board 6.

Figure 5:
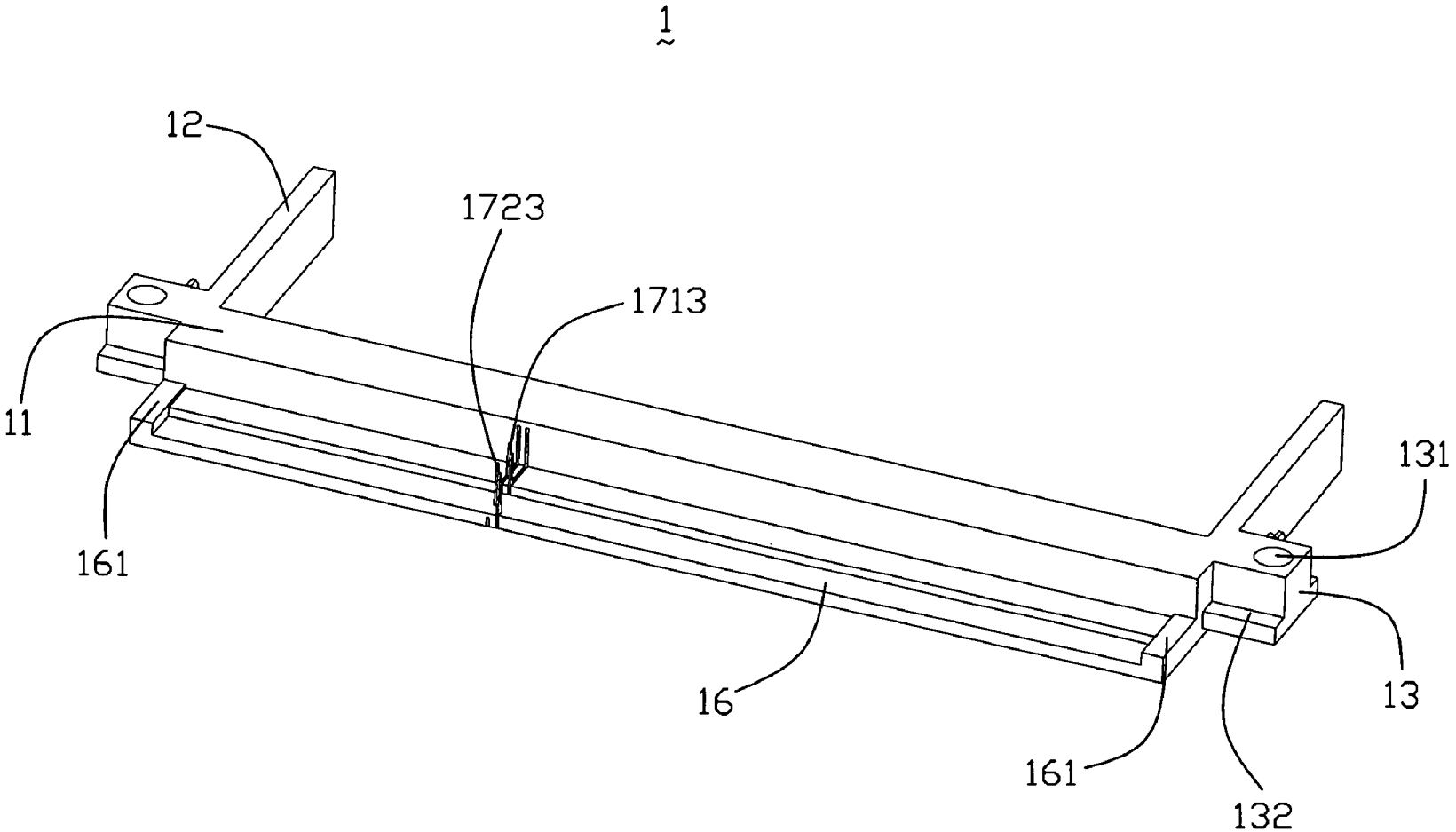
FIG. 5 is a perspective view of the first card edge connector of the electrical connector assembly shown in FIG. 1.
Figure 6:
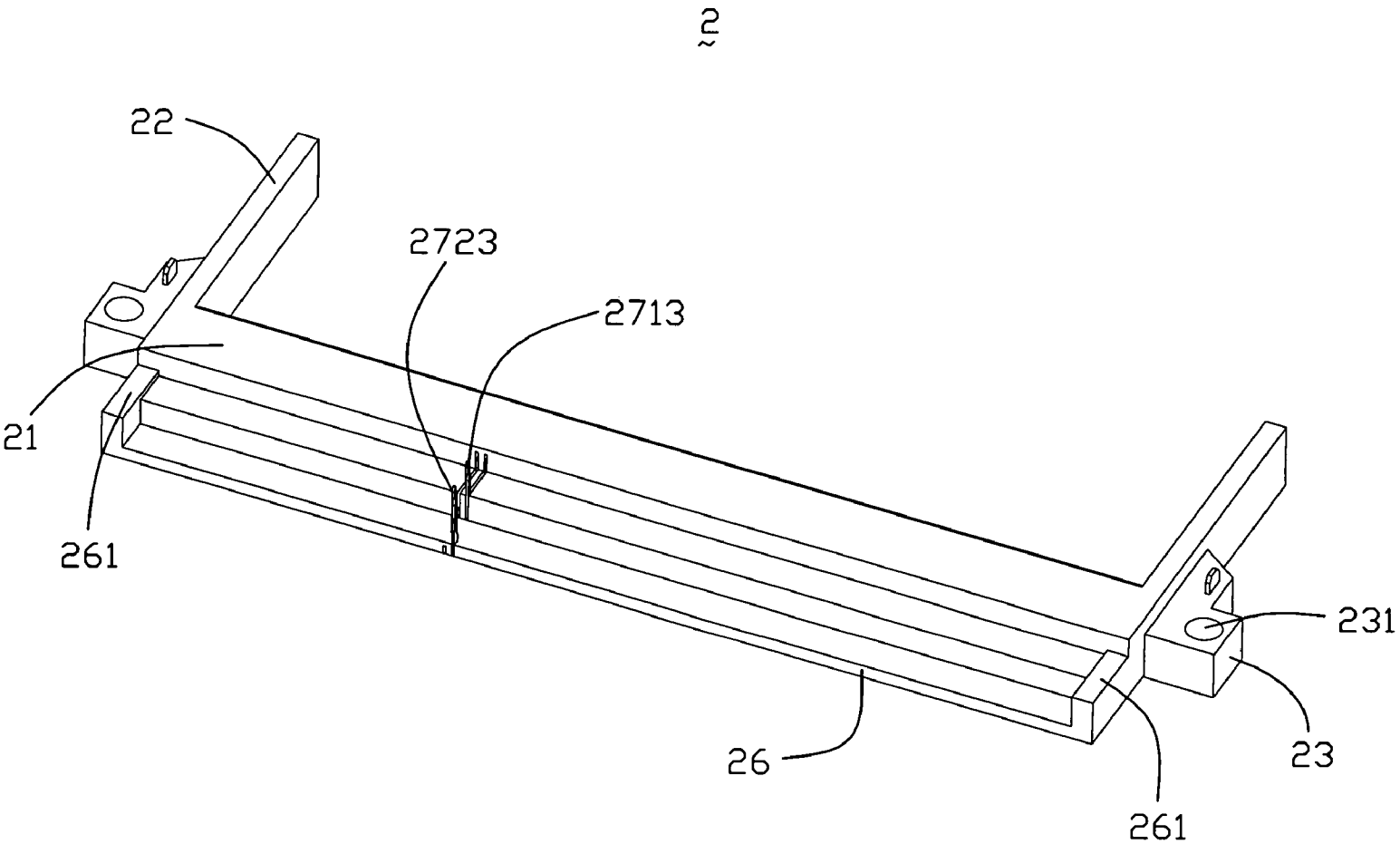
FIG. 6 is a perspective view of the second card edge connector of the electrical connector assembly shown in FIG. 1.

Referring to FIGS. 5 and 6, each supporting portion 13 of the first card edge connector forms a blocking portion 132 extending from a bottom face thereof to abut against a bottom face of the main board 5. An extending portion 16/26 of the first or second card edge connector 1/2 in a step shape extends rearward from the elongated housing 11/21 to cooperate with the conductive terminals, and a pair of holding portions 161/261 extend upwardly from ends of the extending portion 16/26 and abut against the bottom face of the board 5/6. A mating slot 15/25 as shown in FIG. 1 is defined in a front portion of the card edge connector 1/2, and a plurality of terminal grooves are defined at opposite sides of the slot for receiving the conductive terminals.

Figure 7:
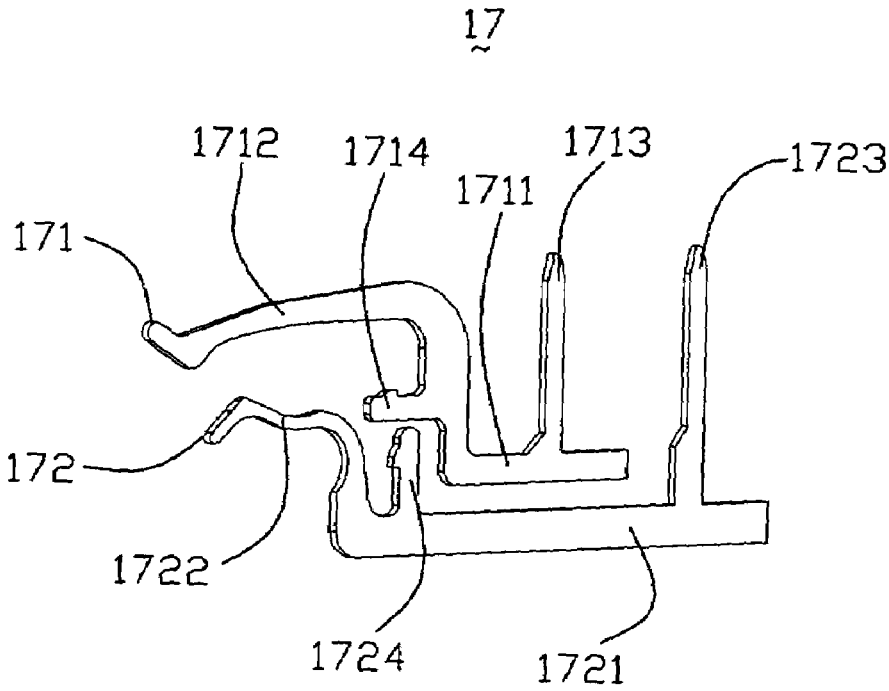
FIG. 7 is a perspective view of a pair of conductive terminals of the first card edge connector shown in FIG. 5.
Figure 8:
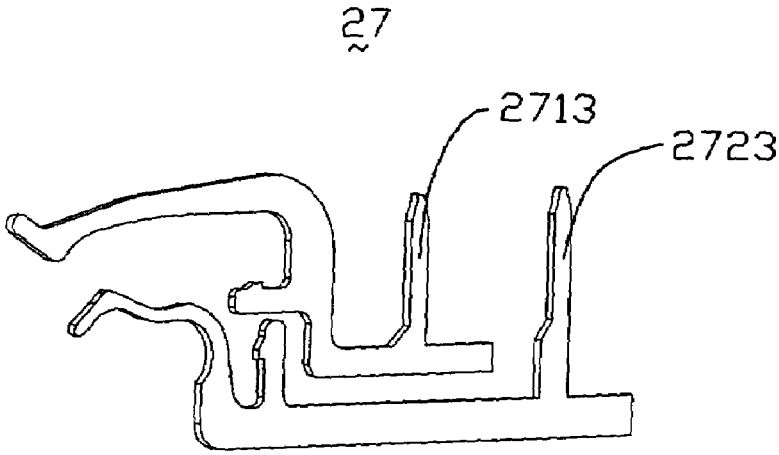
FIG. 8 is a perspective view of a pair of conductive terminals of the second card edge connector shown in FIG. 6.

Referring to FIGS. 7 and 8, the first and second card edge connectors 1, 2 have a plurality of first and second group of conductive terminals 17, 27 mounted therein respectively. As the first and second groups of conductive terminals 17 and 27 are in a same configuration, here will only describe the first group of conductive terminals 17 as an example. The first group of conductive terminals 17 includes an upper terminal 171 and a lower terminal 172, each of which has a main body 1711/1721, a resilient contacting arm 1712/1722 extending upwardly and then forwardly from the main body, and a solder tail 1713/1723 extending upwardly from a rear portion of the main body. The upper terminal 171 has a retaining portion 1714 extending forward from the contacting arm 1712 adjacent to the main body 1711. The lower terminal 172 has a retaining portion 1724 extending upward from the main body 1721 adjacent to the contacting arm 1722. The second group of conductive terminals 27 also has solder tails 2713/2723 retained in the corresponding holes in the sub-board 6.

The contacting arms 1712, 1722 of the first group of terminals 17 expose to the mating slot 15 and the solder tails 1713, 1723 are retained in the corresponding through holes on the main board 5. As the upper contacting arm 1712 extends forwardly further than the lower contacting arm 1722, a module (not shown) should be inserted into the mating slot 15 slantwise from side of the lower contacting arm 1722 and be bend horizontally to the main board 5, so is the second card edge connector 2.

Figure 9:
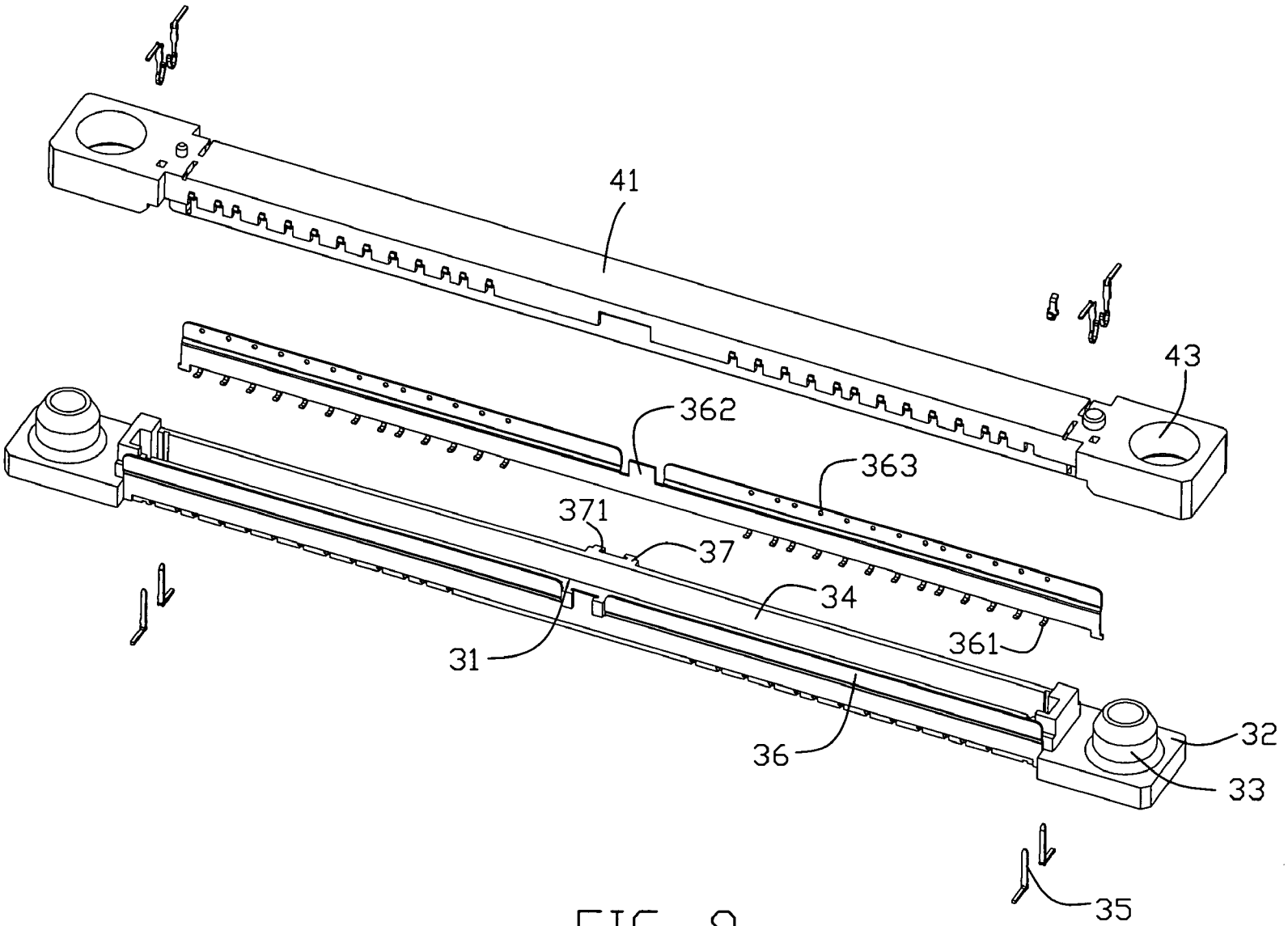
FIG. 9 is an exploded view of the board-to-board connector of the electrical connector assembly shown in FIG. 1.
Figure 10:
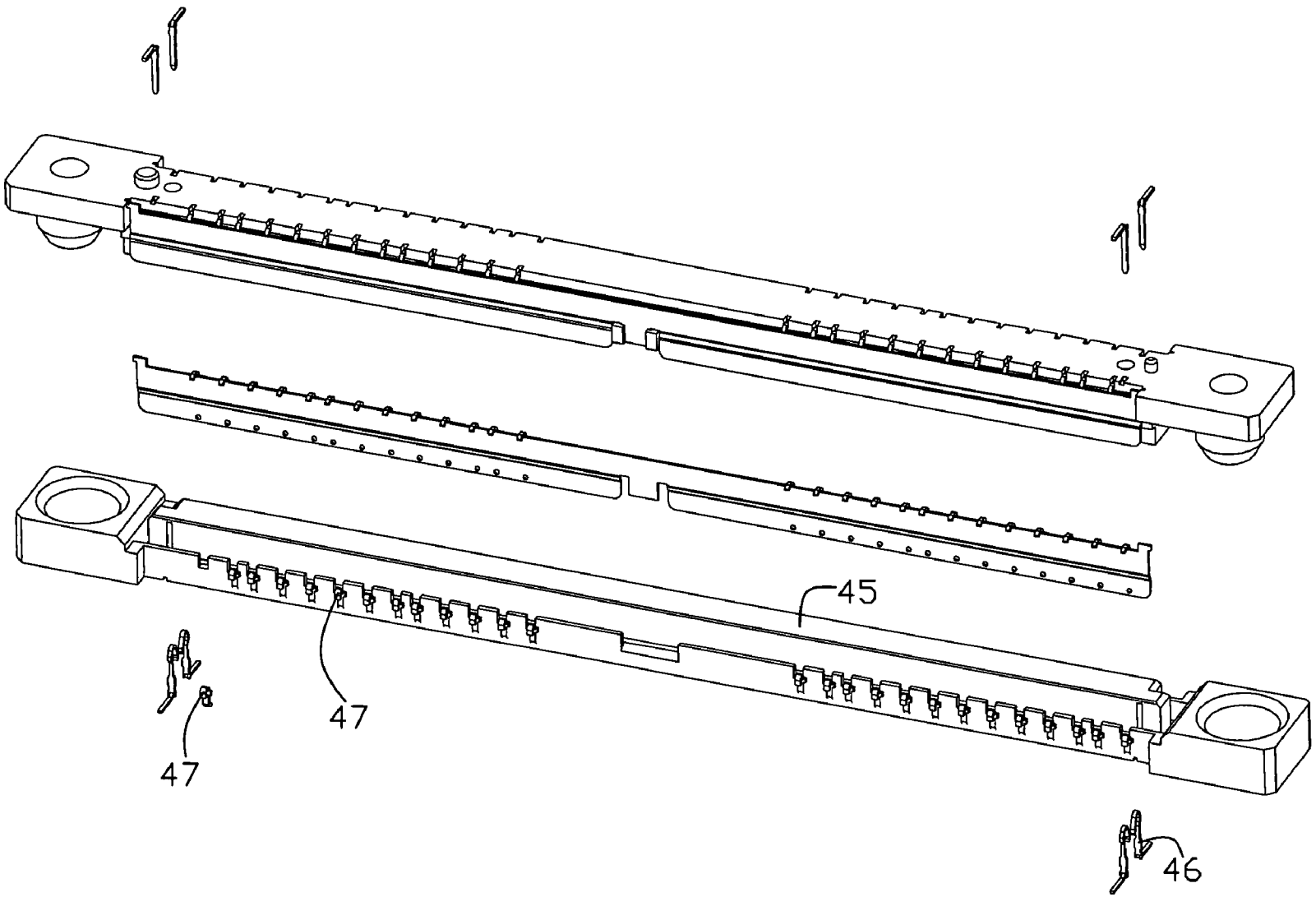
FIG. 10 is another exploded view of the board-to-board connector in FIG. 9.
Figure 11:
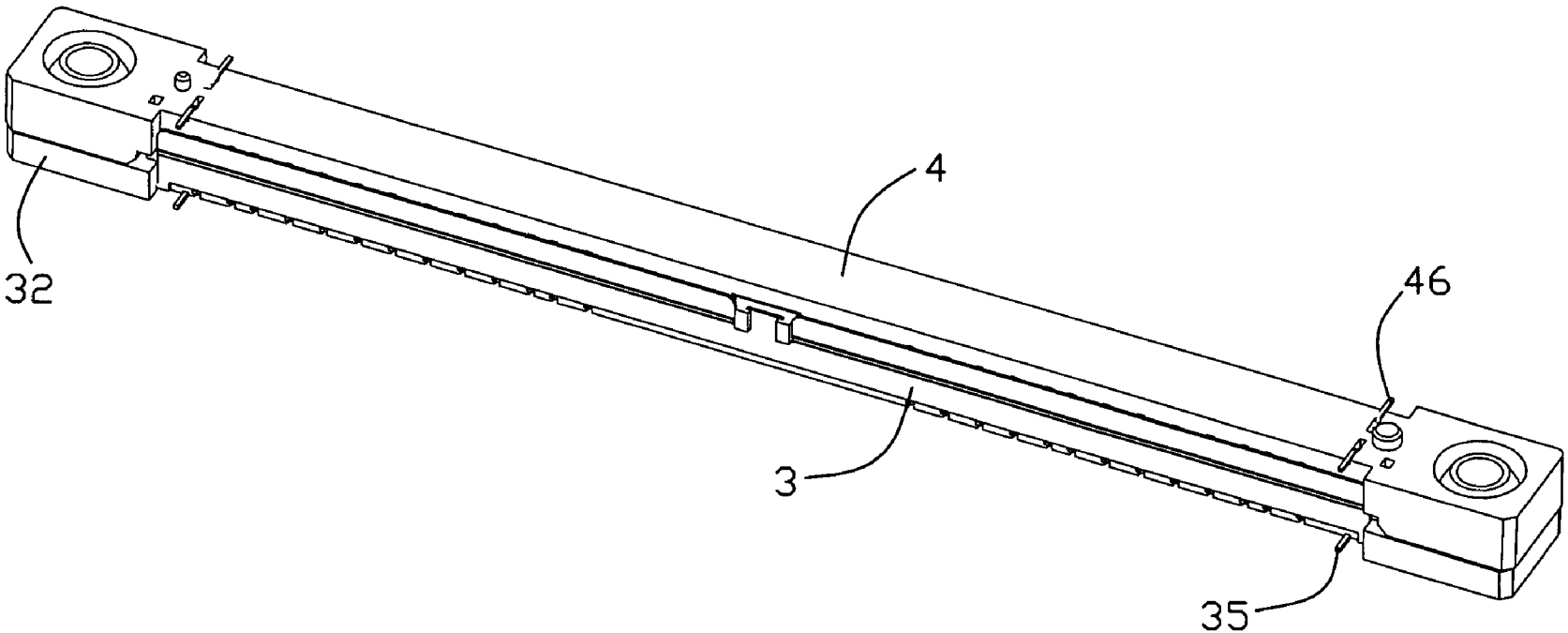
FIG. 11 is a perspective view of the board-to-board connector in FIG. 9.

Referring to FIG. 9 to FIG. 11, the first board to board connector 3 has a longitudinal slot 34 in the elongated housing 31, and a plurality of terminals 35 are arranged at intervals and secured at opposite sides of the slot. A pair of metallic shells 36 are covering on an outer surface of the housing 31, each of which has a plurality of grounding arms 361 extending outwardly from a bottom edge, and a retaining plate 362 extending upwardly from a middle portion of an upper edge thereof. The housing 31 has a pair of protrusion portion 37 protruding outward from the outer surface of the housing, each of which defines a channel 371 therein for receiving the retaining plate 362. The second board to board connector 4 is a complementary connector and has an elongated housing 41 with a longitudinal tongue plate 45 therein. The tongue plate 45 is inserted into the slot 34 of the first connector 3. The tongue plate 45 has a plurality of terminals 46 at opposite sides for electrically contacting with the terminals 35 in the first connector 3. The tongue plate 45 also has a plurality of metallic pieces 47 thereon for mechanically and electrically with the metallic shell 36 so as to accomplish the grounding function.

Referring to FIG. 1 to FIG. 3, when the electrical connector assembly has been assembled, a front portion of the first and second card edge connectors 1, 2 are aligned with each other in the vertical direction and both of the connectors are sinking in the corresponding board, therefore the entire height of the electrical connector assembly is lowness. The second card edge connector 2 is connecting with the main board 5 through the path of the sub-board 6 and the pair of first and second board-to-board connectors 3, 4, therefore, the first and second card edge connectors 1, 2 can be made in a standard configuration without any change.

It is noted that the upper terminals 171 and the lower terminals 172 are inserted into the corresponding passageways in different directions perpendicular to each other, i.e., the upper terminals vertically and the lower terminals horizontally, so as to have the corresponding passageways extending in the different directions, thus avoiding weakened structure of the housing due to extension in the same direction. On the other hand, because the solder tails 1723 are located behind the solder tails 1713, it is preferred to assemble the terminals 171 into the housing before assembling the terminals 172. Alternately, if the solder tails 1713 and 1723 extend in an opposite direction with regard to the current embodiment, the terminals 171 may be inserted into the housing vertically and the terminals 172 horizontally. Anyhow, the present embodiment is arranged to assure the distance between the mating slots 15 and 25 is essentially smaller than that between the main board 5 and the sub-board 6 so that the corresponding memory modules received in the corresponding mating slots 15 and 25 do not exceed, in the vertical direction, the main board 5 and the sub-board 6 protectively for design consideration within a limited space of a laptop computer.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a main board with a first card edge connector mounted thereon;

a sub-board with a second card edge connector mounted thereon;

a pair of complementary board to board connectors mounted on the main board and the sub-board respectively;

wherein the first and second card edge connectors are aligned with each other in a vertical direction and the second card edge connector is on top of the first card edge connector.

2. The electrical connector assembly as described in claim 1, wherein each of the main board and sub-board has a notch, and the first and second card edge connectors are sinking in the corresponding notches, respectively.

3. The electrical connector assembly as described in claim 2, wherein each of the card edge connectors has an insulating housing with a pair of supporting portions at opposite ends thereof, said supporting portions abut against bottom edges of the board around the notch, and a bottom face of the insulating housing locates under the board.

4. The electrical connector assembly as described in claim 3, wherein an extending portion extends rearward from the insulating housing and locates under the board.

5. The electrical connector assembly as described in claim 1, wherein the board to board connectors are located behind the card edge connectors and in a parallel relationship with the card edge connectors.

6. The electrical connector assembly as described in claim 2, wherein said main board and said sub-board are parallel to each other and define a pair of interior faces inwardly facing to each other, and a pair of exterior faces outwardly facing away from each other, said pair of complementary board-to-board connectors are respectively mounted to said interior faces in opposite directions and commonly sandwiched between the main board and the sub-board, while the first card edge connector is mounted on one of said interior face and said exterior face of the main board and the second card edge connector is mounted on the other of said interior and said exterior face of the sub-board so as to have said first card edge connector and said second card edge connector are mounted to the corresponding main board and sub-board in a same direction.

7. The electrical connector assembly as described in claim 6, wherein said first card edge connector and said second card edge connector are arranged in a same orientation, and essentially closely spaced with each other in a vertical direction.

8. The electrical connector assembly as described in claim 6, wherein said first card edge connector is mounted to the exterior face of the main board, and the second card edge connector is mounted on the interior face of the sub-board.

9. The electrical connector assembly as described in claim 6, wherein each of said first card edge connector and said second card edge connector defines an insulative housing not only received in the corresponding notch but also in a portion of a space defined between the notches of said main board and said sub-board in a vertical direction.

10. The electrical connector assembly as described in claim 6, wherein said first card edge connector and said second card edge connector define corresponding horizontal slots to respectively receive first and second memory modules therein under condition that a distance between said two horizontal slots is smaller than that between the main board and the sub-board.

11. An electrical connector assembly adapted for receiving a pair of modules therein, comprising:

a first card edge connector having an elongated slot with an upper row and a lower row of terminals arranged at opposite sides, each terminal having a contacting portion exposing to the slot and a soldering tail extending toward a main board to be soldered onto the main board;

a second card edge connector also having an elongated slot in alignment with the first card edge connector in a vertical direction, connecting to the main board through a path of a sub-board and at least one connecting device;

wherein the contacting portions of the upper row terminals extend forward further than those of the lower row terminals so that said modules are slantwise inserted into said slots.

12. The electrical connector assembly as described in claim 11, wherein each of the first and second card edge connectors has an extending portion extending far away to the contacting portions and located under said board and sub-board, said lower contacting portion is nearer to the extending portion than the upper contacting portion.

13. The electrical connector assembly as described in claim 12, wherein the at least one connecting device is a pair of board to board connectors, and said board to board connectors are located behind the extending portions.

14. An electrical connector assembly comprising:

an electrical connector including an insulative housing defining a horizontal central slot with opposite first and second rows of contacts by two sides of said central slot, said first row of contacts and said second row of contacts being arranged to only allow a corresponding memory module to be inserted into the central slot in a rotating manner compliant with a vertical direction from the first row of contacts to the second row of contacts; and first and second rows of passageways defined in the housing to receive the corresponding first and second rows of contacts, respectively; wherein one of said first and second rows of passageways are configured to only allow insertion of the corresponding row of contacts vertically while the other of said first and second rows of passageways are configured to only allow insertion of the corresponding row of contacts horizontally.

15. The electrical connector assembly as claimed in claim 14, wherein the first row of passageways are configured to only allow the corresponding first row of contacts to be inserted thereinto in said vertical direction, while the second row of passageways are configured to only allow the corresponding second row of contacts to be inserted thereinto horizontally.

16. The electrical connector assembly as claimed in claim 15, wherein said second row of contacts are forwardly/inserted into the corresponding second row of passageways.

17. The electrical connector assembly as claimed in claim 15, wherein the first row of contacts define corresponding first mounting tails extending along said vertical direction, the second row of contacts define corresponding second mounting tails extending along said vertical direction and essentially in front of the first mounting tails so that during assembling the second row of contacts are inserted into the corresponding second row of passageways before the first row of contacts are inserted into the corresponding first row of passageways.

18. The electrical connector assembly as claimed in claim 17, wherein both said first mounting tails and said second mounting tails are located behind the housing.

19. The electrical connector assembly as claimed in claim 17, further including a horizontal printed circuit board defining a mounting face thereon, wherein said first mounting tails and said second mounting tails are both mounted thereto.

20. The electrical connector assembly as claimed in claim 19, wherein said printed circuit board defines a notch in which said housing is received.

* * * * *